United States Patent [19]

Yamamura et al.

[11] 4,216,956

[45] Aug. 12, 1980

[54] RUNNING MACHINE

[75] Inventors: Yukio Yamamura; Tsutomu Ichinomiya; Shinichi Ishimaru, all of Kadoma, Japan

[73] Assignee: Matsushita Electric Works, Ltd., Osaka, Japan

[21] Appl. No.: 884,224

[22] Filed: Mar. 7, 1978

[30] Foreign Application Priority Data

Mar. 7, 1977 [JP] Japan ..... 52-25118

[51] Int. Cl.[2] ..... A63B 23/04

[52] U.S. Cl. ..... 272/70; 272/DIG. 5; 340/323 R

[58] Field of Search ..... 35/29; 272/69, 70, 73, 272/100, DIG. 5, DIG. 6; 73/379; 340/323 R, 384 R, 384 E

[56] References Cited

U.S. PATENT DOCUMENTS

| | | | |
|---|---|---|---|
| 3,580,083 | 5/1971 | Zipser | 272/69 X |
| 3,797,010 | 3/1974 | Adler et al. | 340/323 R |
| 3,848,467 | 11/1974 | Flavell | 73/379 |
| 4,056,265 | 11/1977 | Ide | 272/70 |
| 4,099,713 | 7/1978 | Spector | 272/93 |
| 4,144,568 | 3/1979 | Hiller et al. | 272/70 |

FOREIGN PATENT DOCUMENTS

| | | | |
|---|---|---|---|
| 1350068 | 4/1974 | United Kingdom | 273/73 |

*Primary Examiner*—Vance Y. Hum

*Attorney, Agent, or Firm*—Armstrong, Nikaido, Marmelstein & Kubovcik

[57] ABSTRACT

A running machine is provided which comprises a mat member which is actuated by the tread of an exerciser so as to produce an output signal. A running circuit processes this output signal and produces a first signal when the OFF time interval of the output signal is longer than a predetermined time interval, thereby distinguishing "running" from "walking". A flying time defining circuit, included in the running circuit, defines the predetermined time interval in order to adjust the quantity of motion to be spared in the stepping and an indicating section processes the first output signal from the running circuit to indicate the number of steps.

4 Claims, 43 Drawing Figures

Fig.3
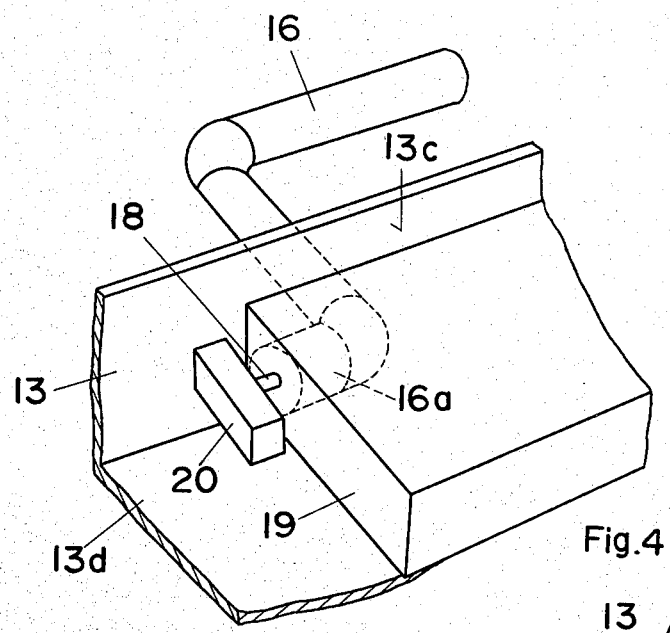
Fig.4
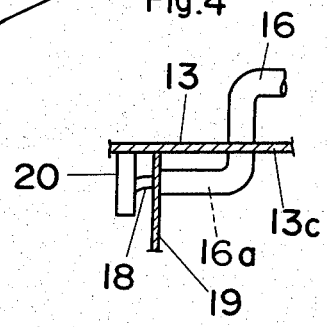
Fig. 5 ( a )
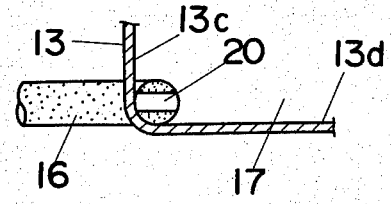
Fig. 5 ( b )
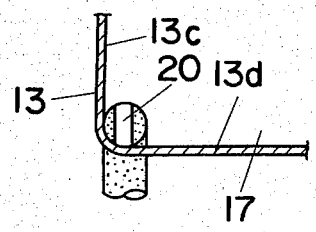
Fig. 5 ( c )
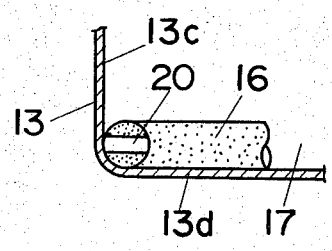

3
35
9
36
8
33
7a
7
31
29
7b
16
41
6
26
17
27
24d
24c
24b
24a
25
5
26
27
28
39
4
40
38
13b
13
13a 13
3
36
35
33
31
7b
7
28
6
5
X
X
37
4
38

3
13a
13b
35
31
28
12
4
13

13b
3
13
44
16
17
14
45
Y
Y 13
3
13a
29
23
23
42
23
23
5
10
11
12

45
14
10
40
12
39

13a
23
13
13b
5
43

Fig. 10 (a)
Fig. 10 (b)
Fig. 10 (c)
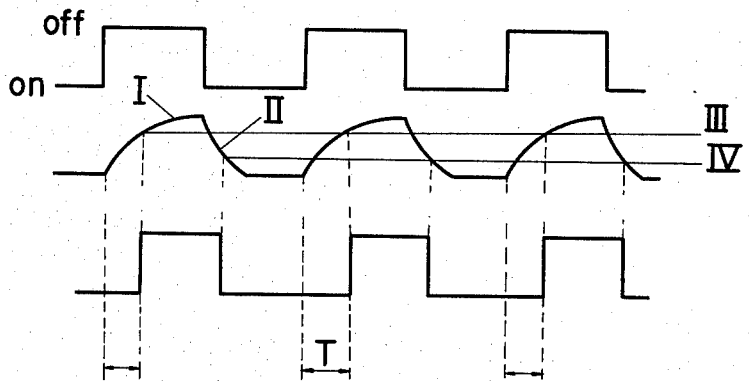
Fig. 11 (a)
Fig. 11 (b)
Fig. 11 (c)
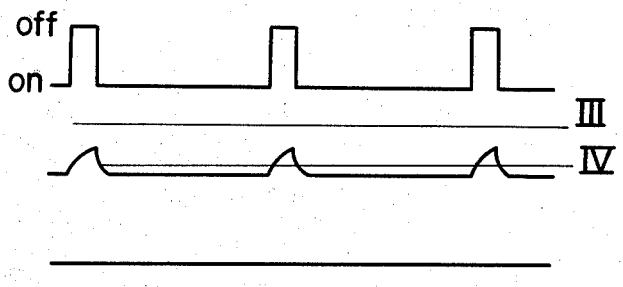
Fig. 12 (a)
Fig. 12 (b)
Fig. 12 (c)
Fig. 12 (d)
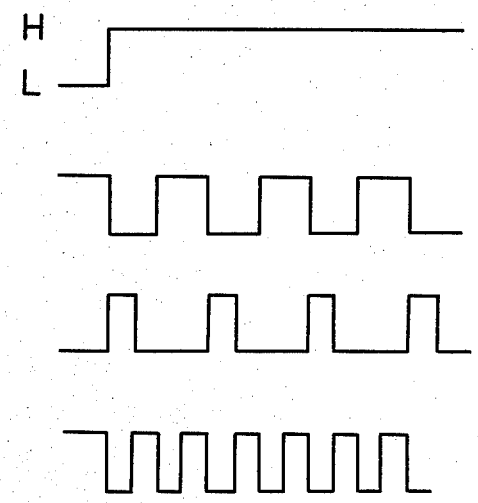

Fig. 13
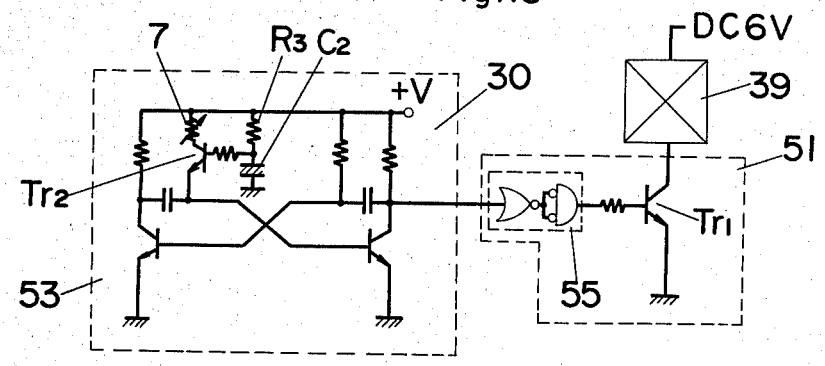
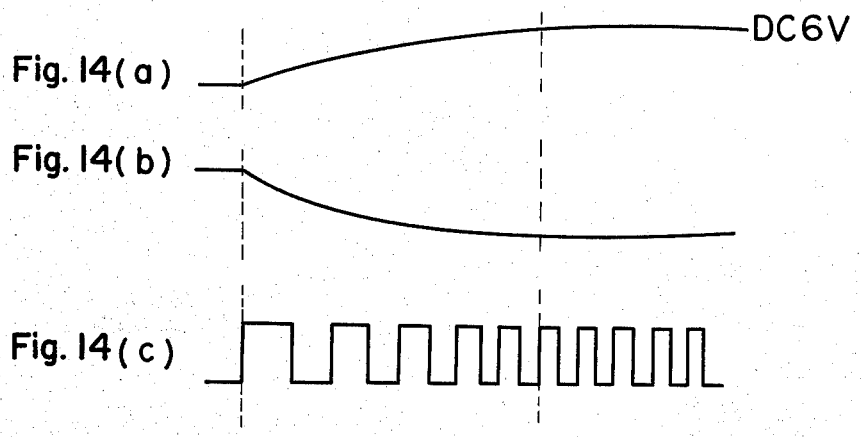
Fig. 15
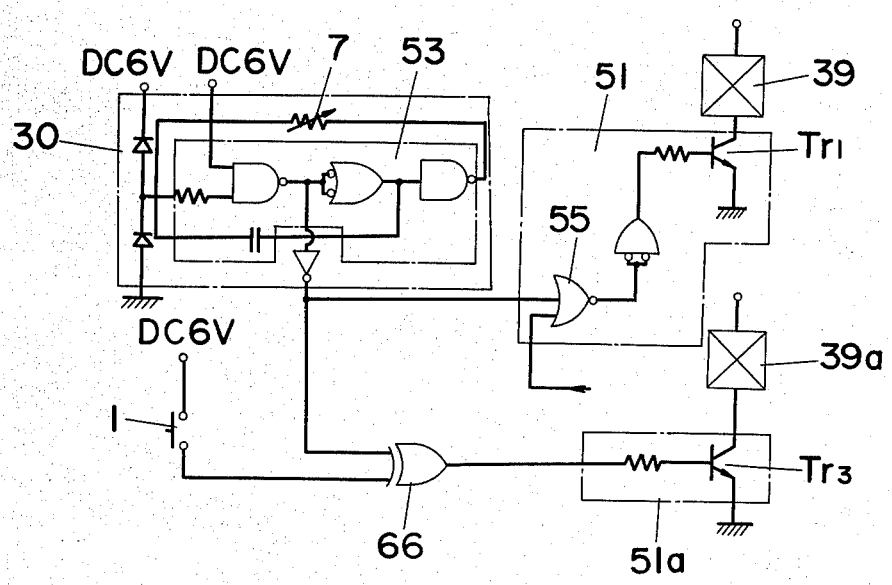

Fig. 16(a)
Fig. 16(b)
Fig. 16(c)
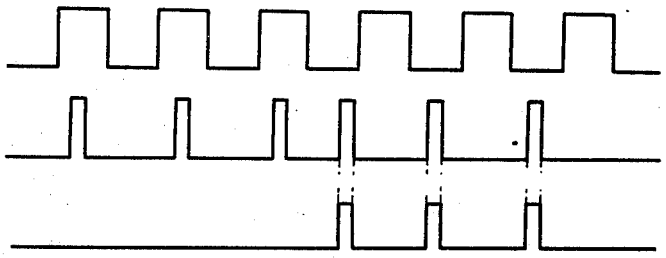
Fig. 17
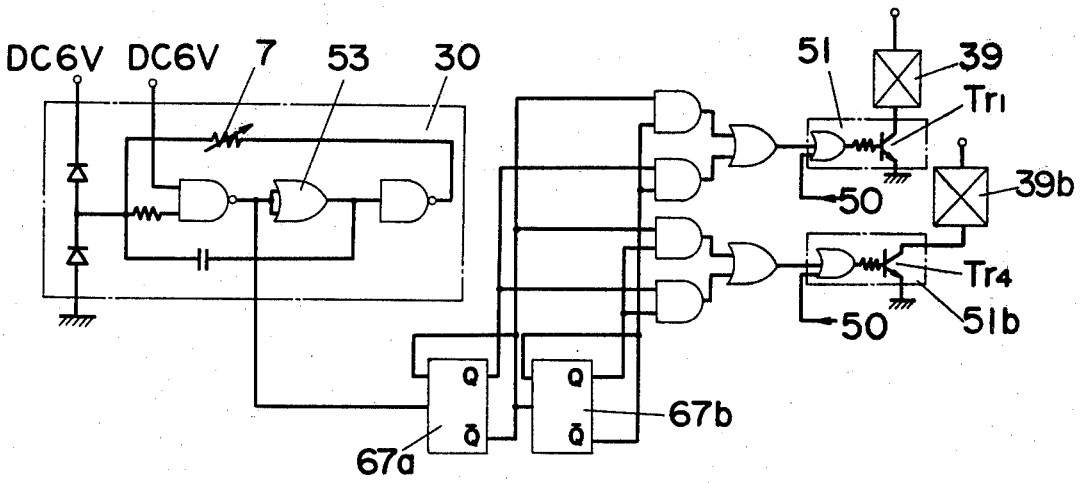
Fig. 18(a)
Fig. 18(b)
Fig. 18(c)
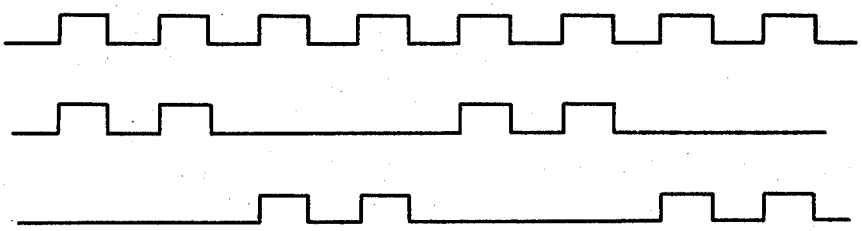

RUNNING MACHINE

BACKGROUND OF THE INVENTION

The present invention relates generally to exercising devices which are used indoors or outdoors for running exercise to promote one's health by improving his physical strength and functions of his heart and lungs and, more particularly, it pertains to a running machine capable of controlling the rate of stepping in accordance with the physical capacity and condition of an exerciser.

It is an object of this invention to provide a running machine which operates only when an exerciser runs on it constantly at a level above a predetermined quantity of motion.

Another object of this invention is to provide a running machine which can adjust the quantity of the motion according to individual differences.

Still another object of this invention is to provide a running machine which indicates the end of exercise by emitting a sound when the number of steps taken by an individual reaches a predetermined value.

Another object of this invention is to provide a running machine that emits an intermittent sound when an individual runs at a slow rhythm.

Still another object of this invention is to provide a running machine which permits free location of a casing with the program and information section, which displays the number of steps, being separate from the housing on which the mat member is mounted.

Further objects of this invention are to provide a running machine which can be transported easily with its casing portions detached; thus preventing the connecting cord from being broken during transportation.

Still a further object of this invention is to provide a running machine in which the connecting cord is stored so as not to be a hindrance when out of use.

BRIEF DESCRIPTION OF THE DRAWINGS

Other objects and attendant advantages of the invention will become more readily apparent and understood from the following detailed specification and accompanying drawings in which:

FIG. 3 is a partial enlarged perspective view of the principal portion of the grip handle of the casing;

FIG. 4 is a partial sectional view of the casing;

FIGS. 5(*a*), 5(*b*) and 5(*c*) are diagrams of the function of the handle;

FIG. 7(*b*) is an enlarged section of the set volume attached to the casing;

FIGS. 7(*c*) and 7(*d*) are enlarged sectional views of the starting switch;

FIG. 8(*b*) is a view showing the upper surface thereof;

FIG. 8(*c*) is a front view of the casing;

FIG. 8(*d*) is a view of the rear surface thereof;

FIG. 8(*e*) is a bottom view of the casing from which the base is removed;

FIG. 8(*f*) is a section taken on line X—X in FIG. 8(*b*);

FIG. 8(*g*) is a section taken on line Y—Y in FIG. 8(*d*);

FIGS. 10(*a*) through 10(*c*) and 11(*a*) through 11(*c*) are views of timing diagrams of the flying duration circuits;

FIGS. 12(*a*) through 12(*d*) are schematic views of timing diagrams of the pacemaker circuit;

FIG. 13 is a schematic view of the circuitry of the pacemaker circuit of a modified embodiment of the invention;

FIGS. 14(*a*) through 14(*c*) are views of the timing diagrams of the pacemaker circuit thereof;

FIG. 15 is a schematic view of the circuitry of the pacemaker circuit of another modified embodiment of the invention;

FIGS. 16(*a*) through 16(*c*) are views of timing diagrams of the pacemaker thereof;

FIG. 17 is a schematic view of the circuitry of the pacemaker circuit of a further modified embodiment of the invention; and FIGS. 18(*a*) through 18(*c*) are views of timing diagrams thereof.

DETAILED DESCRIPTION OF THE PREFERRED EMBODIMENTS OF THE INVENTION

Figure 1:
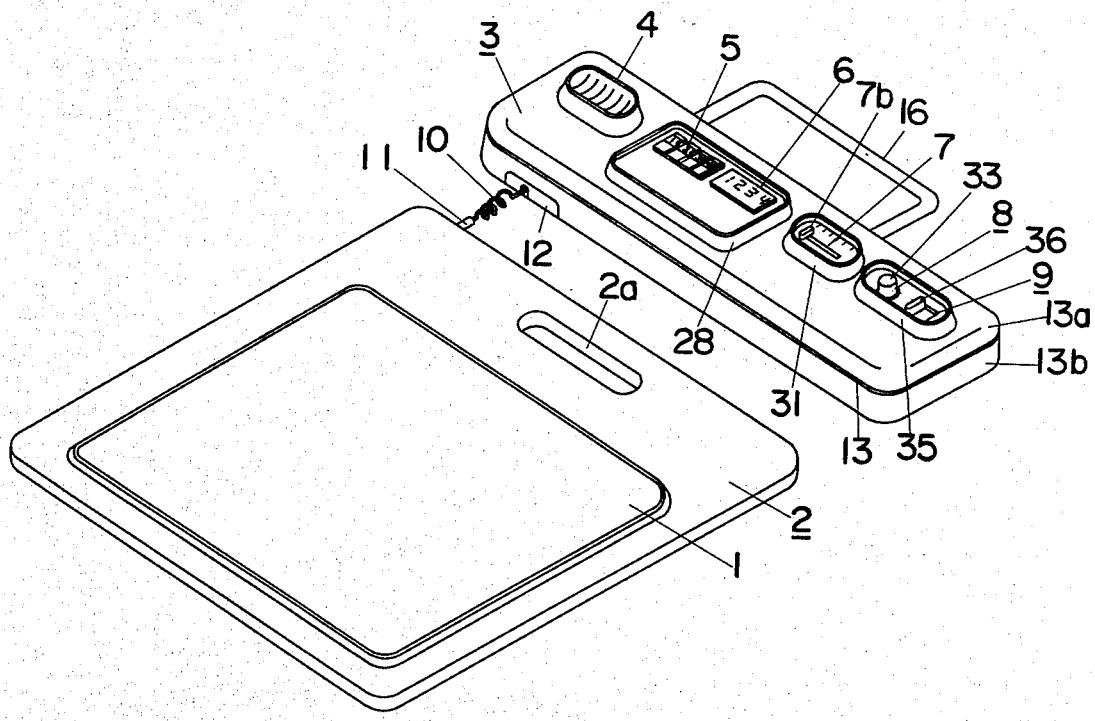
FIG. 1 is a perspective view of an embodiment of the invention.

A running machine of the present invention is constructed basically of two parts, a housing and a casing. The housing includes a running mat 2 having a running detecting switch 1. The casing (hereinafter described as "the main body") 3 has an electric circuit, such as a running counter indicator 6 and a target count setter 5, which are provided separately from each other. The mat switch 1 and electric circuit are detachably connected by a connecting cord 10. FIG. 1 is a perspective view of the preferred embodiment, in which the running mat 2 has a mat switch arranged at the control portion of the mat so that when both of the user's legs are simultaneously in the air above the mat, the mat switch 1 is turned OFF, and when either of the user's legs touch the mat, it is turned ON.

Figure 2:
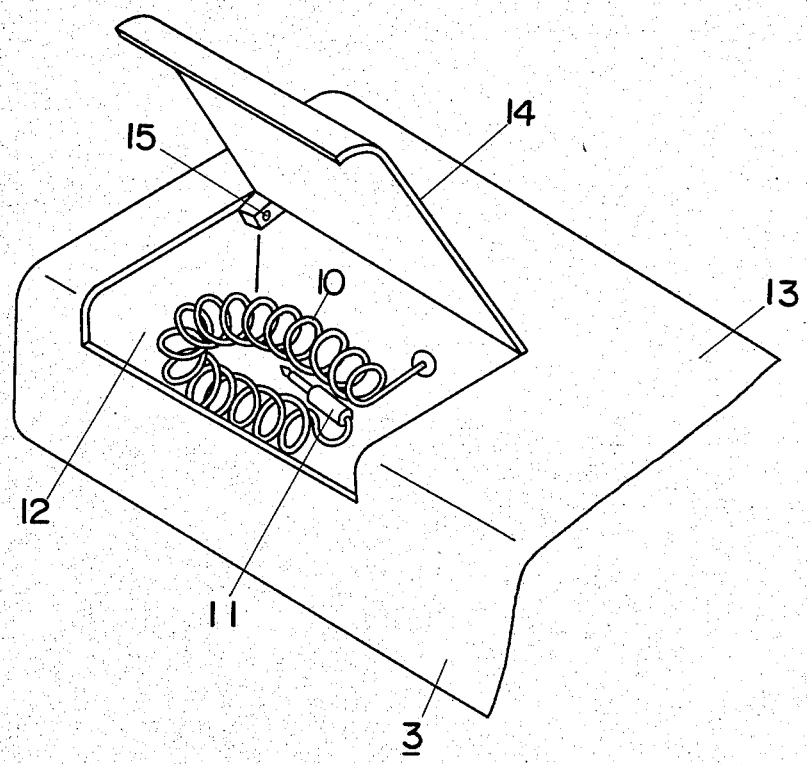
FIG. 2 is a partial enlarged perspective view of the rear of the casing of the present invention.

The main body 3 is formed of synthetic resin in an approximately elongated rectangular prism. The main body 3 houses therein electric circuits and has at the upper surface a packmaker sounder 4, a target count setter 5, a count indicator 6, a pitchset variable register 7, a starting switch 8 and a power supply switch 9, arranged thereon. The electric circuits housed within the main body 3 and the mat switch 1 of the running mat are adapted to be electrically connected by use of a curled cord 10 which is attached to the main body 3 so that it can be housed therein and has, at the terminal, an insertion jack 11 detachably inserted to a plug (not shown) attached to the running mat 2. A space 12 is provided for the curl cord 10. The space 12 is, as shown in FIG. 2, provided at the rear surface at one side of the casing which has a lid 14 pivotably attached by a pivot 15 to the casing 13 for opening or closing an opening thereat. The curled cord 10 stored within the space 12 when out of use makes the casing 13 have a neat appearance, and also the curled cord is easy to store.

Figure 6:
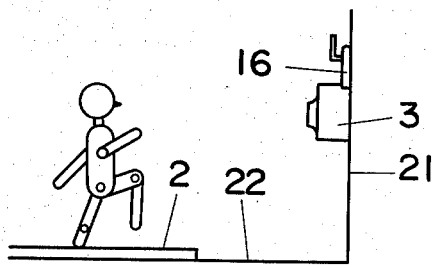
FIGS. 6(*a*), 6(*b*) and 6(*c*) are diagrams illustrating the use of the casing.
Figure 6:
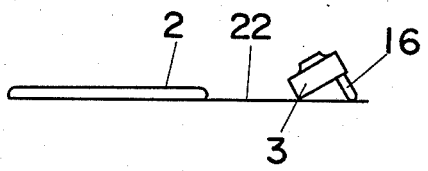
Figure 6:
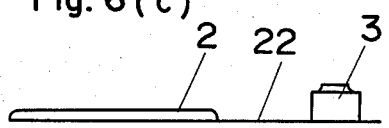

A grip handle 16 is provided for the main body 3. The handle 16 is formed of a rod bent in an approximately U-like shape, which is pivoted to the casing 13 and housed within a recess 17 formed at the rear surface of the casing 13 and opening forwardly and downwardly. In detail, the handle 16 is, as shown in FIGS. 3 and 4, extending laterally at both ends thereof to form two bent portions 16*a*, whose end faces have projecting pins 18 passing through side walls 19 at the front of recess 17, thereby being pivoted to the casing 13. At the tip of each pin 18 is attached a stopper 20 of a rectangular prism-like shape. The stopper 20 contacts an outer wall 13*c* or base 13*d* of the casing, thereby twisting the pins 18 to restrict the handle 16 from being further turned. When the handle 16 is pulled out of the casing, the stopper 20 contacts at its one lengthwise end face with the inner surface of the wall 13*c* as shown in FIG. 5*a*, thereby restricting the handle 16 from being turned. This enables the main body 3 to be carried or hung on a room wall 21 through the pulled-out handle 16. On the other hand, when the handle 16 is pulled out perpendicular to the base of casing 13, the stopper 20 contacts one of its end faces with the inner surface of the base 13*d* of the casing 13 as shown in FIG. 5*b* so as to restrict the handle's turn. In this instance, the main body 3 is, as shown in FIG. 6*b*, placed slantwise on the floor 22 using the handle 16 to facilitate watching the display by the user. Furthermore, the stopper 20, at the other lengthwise end face thereof, contacts the inner surface of the wall 13*c* of the casing when the handle 16 is turned to be housed within the recess 17, as shown in FIG. 5*c*, thus holding the handle therein. Accordingly, the main body 3 can, as shown in FIG. 6*c*, be laid in parallel to the floor 22 or taken away.

In the casing 13 is housed the electric circuit to be hereinafter described and four cells 23 for the power supply. The cells are in lateral alignment and are balanced so as not to tilt the main body 3 when carried. The casing 13, which is formed in an elongated rectangular prism-like shape, can be easily held in the user's hands. At the upper side of casing 13 is provided the target count setter 5 which comprises four target setting switches 24*a*–24*d* which are digital switches. The switches 24*a*–24*d* extend from the casing through a window 25 and are fixed to the casing 13 through two lugs 26 formed at both ends and supported by holders 27 projecting from the walls respectively. The control portions of the switches are surrounded by a wall 28 projecting from the upper surface of casing 13 integrally therewith so as not to project outwardly.

Figure 7:
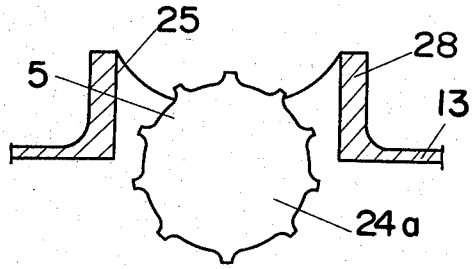
FIG. 7(*a*) is an enlarged section of the target count number setter.
Figure 7:
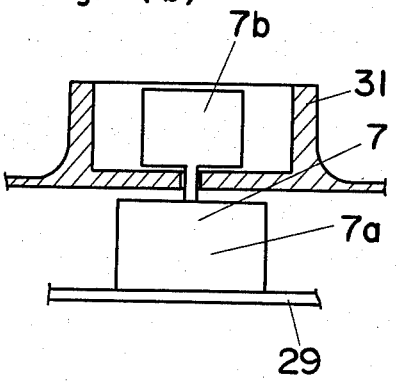
Figure 7:
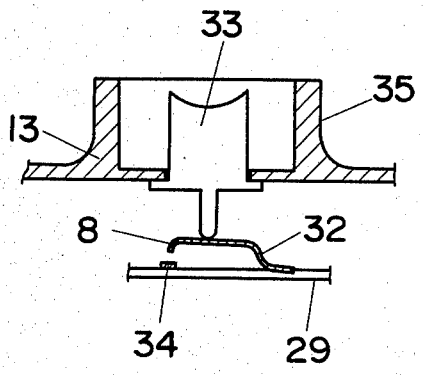
Figure 7:
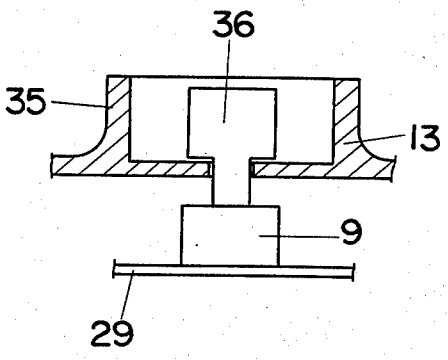
Figure 8:
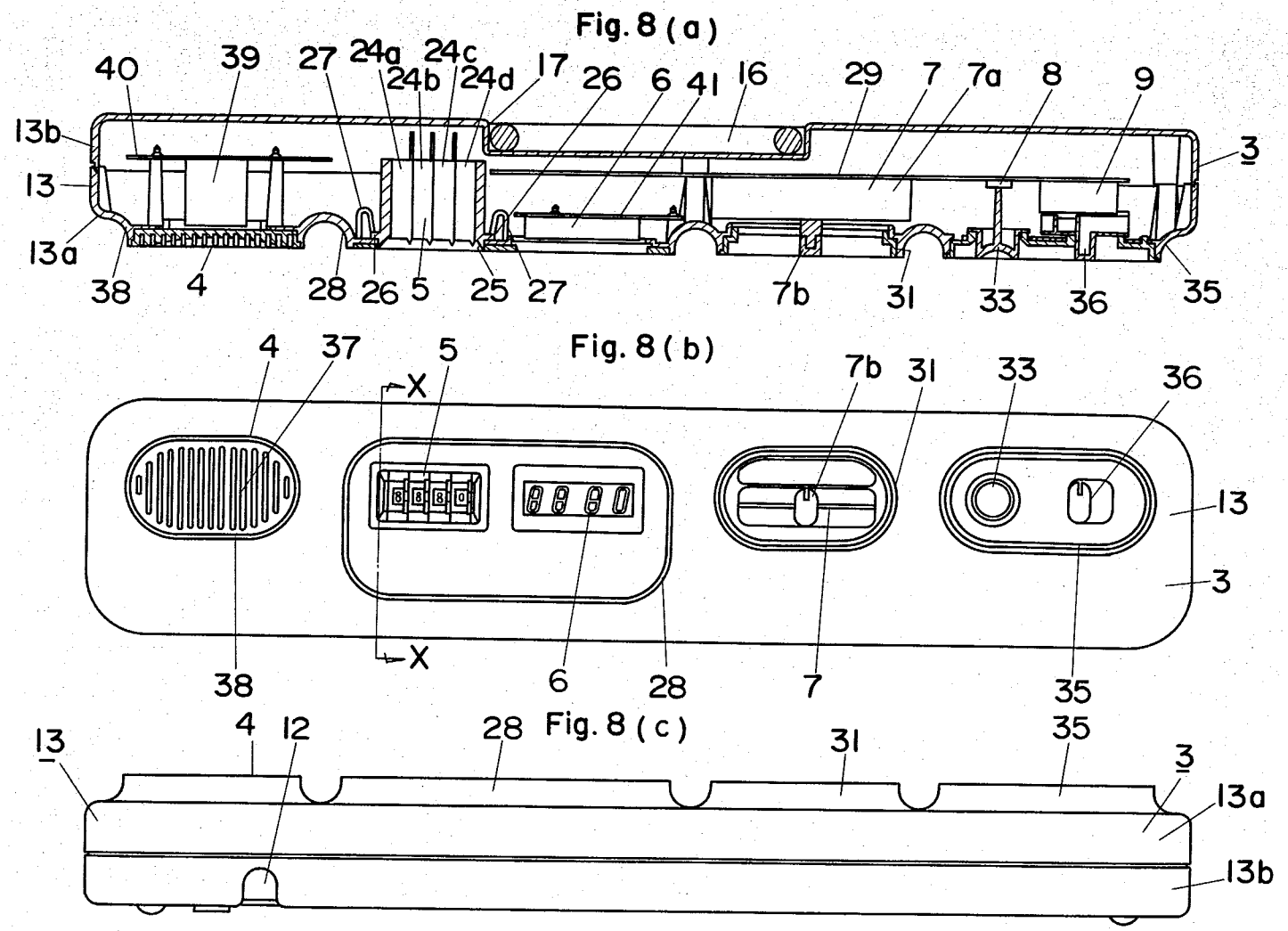
FIG. 8(*a*) is a lengthwise section of the casing.
Figures 8D, 8E, 8F, 8G:
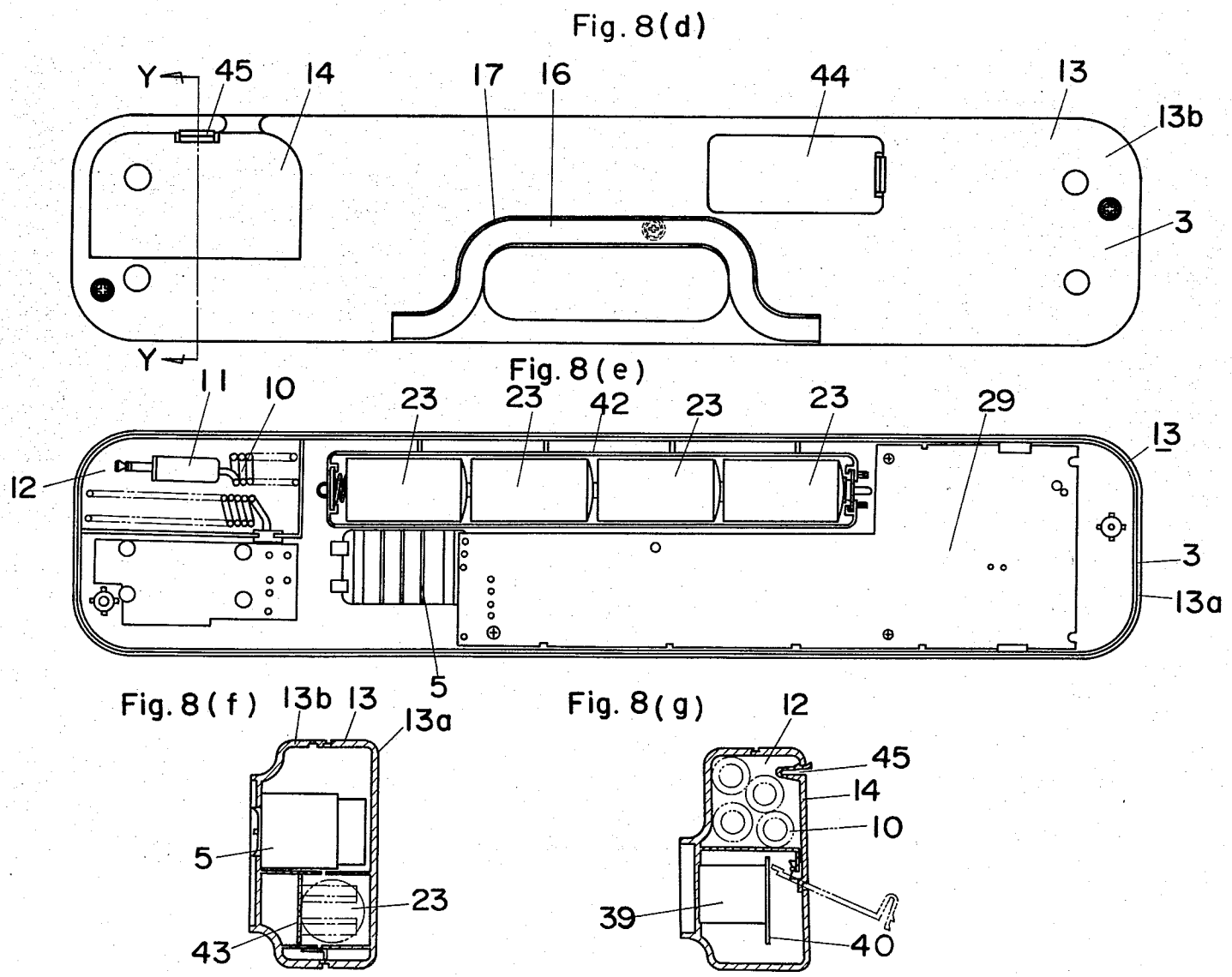

The pitch set volume 7 comprises a slide volume, whose body 7*a* is fixed to a point circuit panel 29 disposed within the casing 13 and whose control knob 7*b* is arranged to be slidably controllable from the outside of casing 13. The control knob 7*b* variably sets the pitch of the pacemaker circuit 30 to be hereinafter described. The control knob 7*b* is surrounded by a wall 31 projecting from the upper surface of casing 31 to thereby be controlled inside the wall as shown in FIG. 7*b*.

The start switch 8 includes a pushbutton 33 which passes through the casing 13 to push with its tip a movable contact 32 attached to the printed circuit panel 29 so that the movable contact 32 is brought into contact with a fixed contact 34. Thus, the number of running steps is counted by turning the start switch 8 ON. In addition, the start pushbutton 33 and a knob 36 of a power supply switch 9, such as a slide switch, are surrounded together with a wall 35 projecting from the upper surface of casing 13, the knob 36 being exposed therefrom. The count indicator 6 is also surrounded by the wall 28 surrounding the target count setter 5. Such encirclement of the target count setter 5, count indicator 6, pitch-set volume 7, starting switch 8 and supply switch 9, with the walls 28, 31 and 35, respectively, makes it possible to prevent the inner circuits and printed circuit panel 29 from being subjected to an external force even when trod on by the user during running, thus securing their safety. Also, nothing projecting from the walls catches the body on a foreign object when carried or taken away, where each of the walls 28, 31 and 35 are substantially levelled.

The packmaking sound emitter 4 has a buzzer 39 housed within a projection 38 which is formed at the upper surface of casing 13 and has a window 37 comprising a plurality of widthwise cutouts, the projection 38 being substantially levelled with the aforesaid walls. In addition, in the drawings, 40 is a mounting plate for mounting the buzzer 39 to the casing 13; 41 is a fixed plate for mounting the count indicator 6 to the casing; 42 is a cell holder; 43 is a cell protector of synthetic fiber, 44 is a lid for an opening passing through the rear of casing 13 to receive cells therefrom; and 45 is a pushlock for holding the closed lid 14 of curled cord space 12. Incidentally, the casing 13 is divided into the upper lid 13*a* and base 13*b*, and 2*a* is a grip for the running mat 2.

Figure 9:
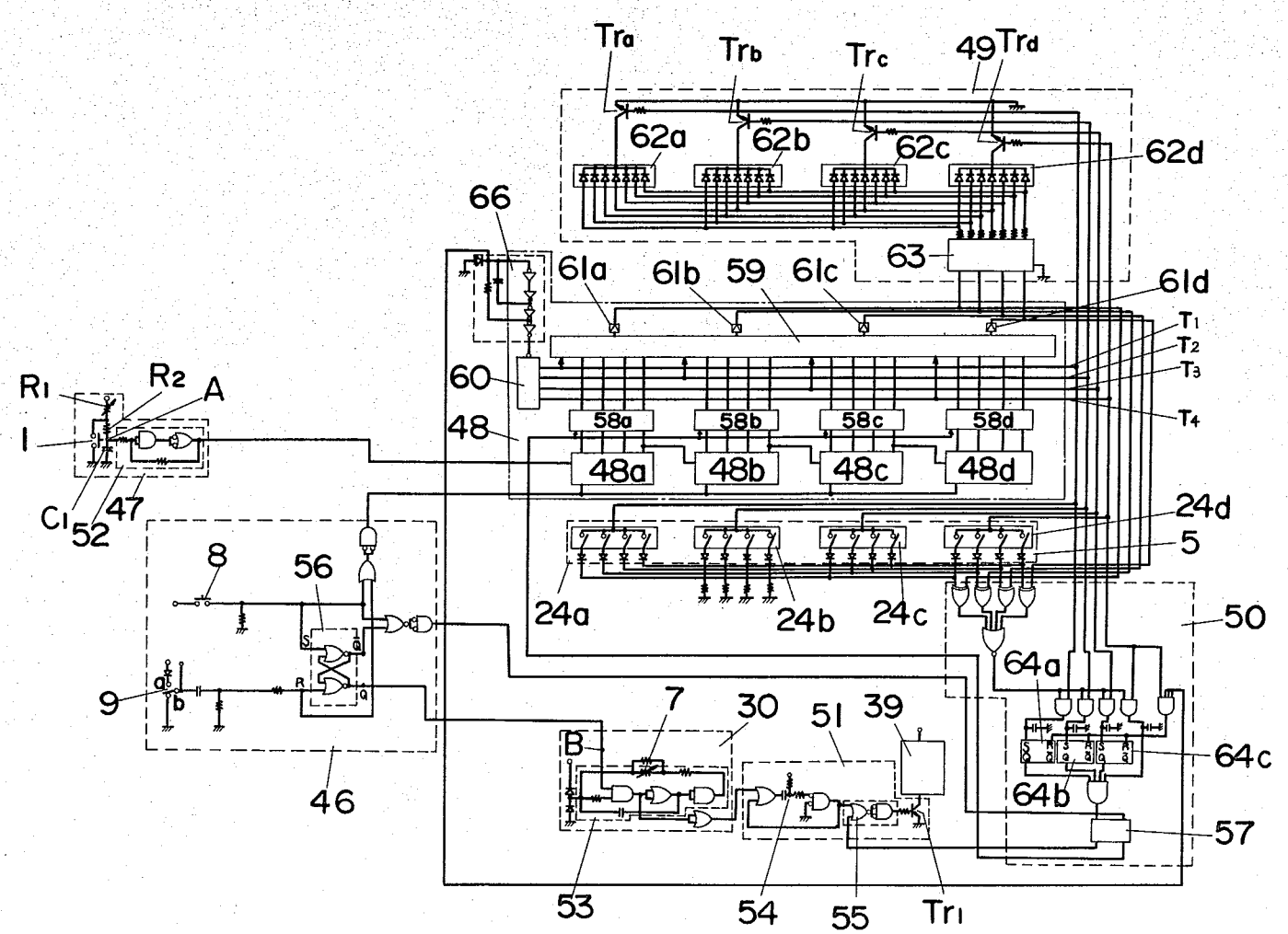
FIG. 9 is a schematic view of the electrical circuit of the invention.

The running circuit of an embodiment of the invention is shown in FIG. 9, in which 46 is a power supply switch and starting switch closing circuit. Numeral 47 designates a flying duration circuit; 48 is a running counter circuit; and 49 is a display element driving circuit for the count indicator 6. Numeral 30 designates a pacemaker circuit, 50 is a sum-coincidence circuit; and 51 is an audible indicator driving circuit for actuating the buzzer 39 to the pacemaking sound circuit 4. The flying duration circuit 47 is provided in view of the fact that each user who runs on the mat is different in style and amount of exercise, such as lifting his legs very high or not so high. The circuit 47 serves to secure the exercise amount over the fixed extent for promoting the health of the person exercising.

Next, the function of flying duration circuit 47 will be detailed as follows: When the user runs on the running mat 2, the mat switch 1 turns ON and OFF. When the mat switch 1 turns OFF, i.e., the user is in the air. The integral circuit comprises variable resistance $R_1$, resistance $R_2$ and condensor $C_1$, which allows voltage at the point A as shown to draw the charge curve I as shown in FIG. 10*b*. When OFF, the user treads on the mat, the discharge circuit of condensor $C_1$ and resistance $R_2$ allows the voltage to form the discharge curve II as shown in FIG. 10*b*. The condensor $C_1$ is, when the mat switch 1 is turned OFF, charged to have its terminal voltage reach a high level operating voltage of a Schmitt trigger circuit 52, then the output thereof is at the "H" level. On the other hand, when the mat switch 1 turns ON, the condensor $C_1$ is discharged to a low level operating voltage of the Schmitt trigger circuit 52 and the output becomes the "L" level. The outputs are alternately at the "H" and "L" levels of the Schmitt trigger circuit and produce running count pulses as shown in FIG. 10*c*, which pulses are counted by a counting circuit 48 to be hereinafter described. When the variable resistance $R_1$ is set to an adequate value of change the charge curve so that the time "T" from "L" level to "H" may be set, the time "T" is called the "flying duration". Schmitt trigger circuit 52 is not activated and the aforesaid count pulses are not produced unless the mat switch 1 is turned OFF, i.e., the runner is in the air during the flying duration.

FIG. 11*a* represents the output of the mat switch 1 when running within the flying duration "T", and FIG. 11*b* is the voltage at the point A, with FIG. 11*c* being the output (running count pulse) of Schmitt trigger circuit 52, and Ⓐ Ⓑ in the drawing represent operating voltage thereof, respectively. This arrangement of the flying duration circuit 47 forces the user to run and always stay in the air for a fixed time in order to increase the running count number, resulting in constant exercise. Also, the flying duration circuit 47 serves as a miscount prevention circuit because no count pulse is produced by a short period pulse, for example, chattering of the mat switch 1.

The pacemaker circuit 30 has been designed in view of the fact that running in constant rhythm is less tiring in comparison with irregular running steps. Therefore, the circuit is adapted to sound rhythmically a constant rate. When voltage at the point B reaches the "H" level in FIG. 12*a*, an astable oscillation circuit 53 operates to produce pulse signals with a constant period, which pulse signals actuate a monostable oscillator circuit 54 to produce the pulse signals shown in FIG. 12*c*. The pulse signals are applied to the base of the transistor $Tr_1$ through the OR circuit 55, thereby driving the transistor $Tr_1$ of sound emitting circuit 51. The transistor $Tr_1$, when turned ON and OFF, allows the buzzer 39 connected in series thereto at the pacemaker sounder 4 to sound intermittently, thereby making a pitch sound. In addition, the pitch set volume 7 is properly controllable to adjust the pitch frequency as desired, as shown in FIG. 12*d*.

The sum coincidence circuit 50 operates to inform the user of completion of a target count number. Prior to running, the target number of the running count is set by digital type target setting switches 24*a*, 24*b*, 24*c* and 24*d*, provided at the target count setter 5. The count number is, when reaching the target number detected so as to change the sound of the buzzer 39, so that the user receives an audible indication without being disturbed in his running rhythm.

The supply switch and starting switch closing circuit 46 comprises flip-flop 56 or the like. The supply switch 9 is switched from the "b" terminal to the "a" terminal, so as to set the Q output of flip-flop 56 at the "L" level and $\overline{Q}$ output at the "H" level. The OR output of the output of supply switch 9 and that of starting switch 8 resets counters 48*a*–48*d* at each unit of counting circuit 48. Next, when turning the starting switch 8 ON, the Q output and the $\overline{Q}$ output of the flip-flop 56 are inverted to reset the final flip-flop 57 of the sum coincidence circuit 50, and set the level at the point B of pacemaker circuit 30 at the "H" level, thereby starting the operation of the pacemaker circuit 30. The counter circuit 8 counts the output pulse of the flying duration circuit 47 using four unit counters 48*a*–48*d*. The resultant count at each unit is applied to the multiplexer 59 as timing signals $T_1$–$T_4$ through latch circuits 58*a*–58*d* which correspond to the counters 48*a*–48*d*. The binary corded output signal of the multiplexer 59 is applied to the display element driving circuit 49 and target setting switches 24*a*–24*d* through amplifiers 61*a*–61*d*.

The display element driving circuit 49 comprises the count indicator 6 having seven segment display elements 62*a*–62*d*, switching transistors Tr*a*–Tr*d* corresponding to each of the display elements 62*a*–62*d*, and BCD circuit 63 for driving each segment of the display elements 62*a*–62*d* by transforming the binary coded signals from the amplitifers 61*a*–61*d* into a decimal coded signal. Each timing signal $T_1$–$T_4$ of T-counter 60 thus turns each of transistors Tr*a*–Tr*d* at each unit ON, thereby allowing each of the display elements 62*a*–62*d* at each unit to be displayed in luminescence. In addition, each timing signal operation is carried out extremely quickly so that the display is visible without any significant delay and, thus, figures at four units are easily readable on the luminous display. On the other hand, the target setting switches 24*a*–24*d* are, when set to the control values, set in an ON-OFF pattern corresponding to the control value so as to be transformed into a binary code. Thus, each timing signal $T_1$–$T_4$ of T-counter 60 gates binary coded outputs of amplifiers 61*a*–61*d* to be applied to the sum coincidence circuit 50. The sum coincidence circuit 50 compares the target set number with count number every unit so as to set the flip-flops 64*a*–64*c* corresponding to each unit of 1,000, 100 and 10 in relation of being coincident with figures from upper to lower in sequence, so that when the lowest unit is coincident, the flip-flop 57 is set. When the flip-flop 57 is set, the Q output locks at the "H" level the output of the OR circuit 55 of sounding circuit 51 and the $\overline{Q}$ output locks of each of latch circuit 58*a*–58*d* of the counting circuit 48, thereby restricting further counting. In addition, 66 is an oscillator circuit for producing clock pulses for T-counter 60.

Next, the operation of the running machine of the invention will be detailed as follows:

First, the main body 3 is arranged as shown in FIGS. 5*a*–5*c*. The curled cord 2 is connected through its jack 11 to the plug in the mat switch 1. The power supply switch 9 is turned ON and the counter circuit 48 and the count indicator 6 are reset. Then, the user runs on the mat 2 for five minutes as quickly as possible for measuring his physical strength, and then compares the indicated number with the running ability rank in Table 1 so as to set his target in such a manner that his target number and pitch are decided in accordance with the standard running prescription in Table 2, following ranks 1 to 10. The target setting switches 24*a*–24*d* of the count number target setter 5 are set at the desired values respectively and also the pitch set volume 7 is optionally slidably set.

Next, the pushbutton 33 is pushed to turn the starting switch ON, so that the counting circuit 48 is again reset and the pacemaker sound corresponding to the pitch set number is emitted in succession from the buzzer 39 at pacemaker sounder 4. The user starts to run in pace with the sound. When running on the mat, he lifts both of his legs in a manner that, at one point, both legs are in the air so as to turn the mat switch ON. The user's motion continues to turn switch 1 ON and OFF. The ON-OFF switching is counted by the counter circuit and displayed continuously by display elements 62*a*–62*d* of indicator 6. Thereafter, the count member reaches the target, which is detected by the sum coincidence circuit 50 and the buzzer 39, which produces the pitch sound while running, produces a continuous sound, thereby informing the user of obtaining his goal.

TABLE 1

| Sex Dist. | Rank | Count Number For 5 Minutes | 20–29 | 30–39 | 40–49 | 50–59 | 60–above |
|---|---|---|---|---|---|---|---|
| | 1 | 1355–above | 1450 | | good | | |
| | | | | 1410 | 1370 | | |
| | 2 | 1305–1354 | | | | 1330 | |
| | | | 1300 | | Fair | | |
| | 3 | 1205–1304 | | 1235 | | | 1300 |
| | | | | | 1190 | | |
| | 4 | 1105–1204 | | | | 1145 | |
| | | | 1100 | | Aver. | | 1100 |
| | 5 | 1005–1104 | | 1035 | | | |
| | | | | | 1010 | | |
| M | 6 | 905–1004 | | | | 960 | |
| A | | | 915 | | | | 915 |
| N | 7 | 805–904 | | 870 | Sl.bad | | |
| | | | | | 825 | 760 | |
| | 8 | 705–804 | | | | | 735 |
| | | | | | Bad | | |
| | 9 | 655–704 | | | | | |
| | 10 | 655–under | | | | | |

TABLE 2

| Sex Dist. | Rank | 6 times wk.-15 minutes Target | Pitch | 3 times wk.-30 minutes Target | Pitch | Once a week Target | Pitch |
|---|---|---|---|---|---|---|---|
| | 1 | 2900 | 185 | 5000 | 165 | 8200 | 135 |
| | 2 | 2750 | 180 | 4800 | 160 | 7900 | 130 |
| | 3 | 2600 | 170 | 4500 | 150 | 7500 | 125 |
| MAN | 4 | 2400 | 160 | 4100 | 135 | 6900 | 115 |
| | 5 | 2200 | 145 | 3750 | 125 | 6300 | 110 |
| | 6 | 2000 | 130 | 3450 | 115 | 5700 | 100 |
| | 7 | 1800 | 120 | 3150 | 110 | 5100 | 95 |
| | 8 | 1600 | 110 | 2700 | 100 | 4500 | 95 |
| | 9 | 1400 | 105 | 2400 | 95 | 4050 | 90 |
| | 10 | 1300 | 100 | 2200 | 90 | 3700 | 90 |

In addition, the above Tables are for reference; hence, any other tables may be available.

In the aforesaid embodiment, when the starting switch 8 turned ON after turn-on of the supply switch 9, the buzzer 39 produces a pitch sound, but it is difficult to tune the user's steps to the pitch sound when set to an especially rapid pitch. Hence, the astable oscillator circuit 53, as shown in FIG. 3, is oscillated in a lagging pitch by means of the resistance $R_3$, condensor $C_2$ and transistor $Tr_2$, soon after closing the starting switch 8, and then the pitch, as shown in FIG. 14*c*, is made gradually faster as the condensor $C_2$ charges so that the pitch reaches the pitch number set by the user after several to several-tens seconds, thereby easily tuning his steps to the pitch sounds. In detail, in the circuit shown in FIG. 13, voltage of the condensor $C_2$, when turning the starting switch 8 ON, has an RC charge curve as shown in FIG. 14*a*, but if the operable area of transistor $Tr_2$ is used, the transistor $Tr_2$ impedance becomes as shown in FIG. 14*b*. The impedance change is used to allow the astable oscillator circuit 53 to have its oscillation period changing from a long period to a short period following the gradually decreasing impedance of the transistor $Tr_2$. As a result, the oscillation is carried out in a constant period when the condensor $C_2$ is charged to the supply voltage.

Furthermore, it is effective for the user to run at a continuous pitch suitable for him, but his running steps are presumed not to be tuned to the pitch sounds, and it is very difficult to run in constant pitch, especially when in quick pitch. Hence, in the circuit shown in FIG. 15, exclusive OR circuit 66 gates pitch signals and ON-OFF signals of the mat switch 1 so that when pitch signal shown in FIG. 16*a* is coincident with the mat switch ON signal in FIG. 16*b*, the output of exclusive OR circuit 66 is not generated, and when the mat switch ON signal is delayed, the output from the OR circuit actuates the transistor $Tr_3$ at the alarm signal generating circuit 51*a*, thereby sounding the buzzer 39*a*.

It is said that a runner is less tired by respiration at a set of "inhale, inhale" "exhale" and "exhale" while running, such as in a marathon, for a long time. Of course, the pacemaker circuit may, as shown in FIG. 17, actuate two sound circuits 16 for inhalation and exhalation. In greater detail, the output signal of astable oscillator circuit 53 is used as a clock pulse for a first flip-flop 67*a*, whose $\overline{Q}$ output is used for a clock pulse for a second flip-flop 67*b*, the AND gate output of the $\overline{Q}$ output of the first flip-flop 67*a* and the $\overline{Q}$ output of the second flip-flop 67*b* are OR-gated to thereby produce a pulse signal of one unit of two continuous pulses for inhalation, as shown in FIG. 18*b*. The AND gate output of the $\overline{Q}$ output of the first flip-flop 67*a* and of the Q output of the second flip-flop 67*b* and that of the Q output of the first flip-flop 67*a* and of the $\overline{Q}$ output of the second flip-flop 67*b* are OR-gated to thereby produce a pulse signal of one unit of two continuous pulses for exhalation as shown in FIG. 18C. The pulse signals actuate the transistor $Tr_1$ of the inhalation sounding circuit 51 and $Tr_4$ of the exhalation sounding circuit 51*b*, respectively, so that the buzzer 39*b* produces different sounds, thereby enabling the user to be less tired by tuning his breathing to these sounds.

The running machine of the invention has advantages such that the running mat provided with the running detecting mat switch and the main body provided with the indicator and target setter are formed separately from each other and the mat switch and electric circuit are detachably connected to each other by a cord so that the main body may be disposed at the position where the count indicator and target count number setter are readily visible, thus facilitating its use, and also disposed not to be trod upon by the user while he is running, thereby preventing the main body from being damaged. Moreover, the main body and running mat are detachably connected by the cord, whereby they are convenient to be carried individually and easy to be set for use.

We claim:

1. A running machine comprising a mat means having mat switch means for producing a first output signal when the mat means is depressed, a running circuit means coupled to said mat switch means for processing the output signal from the mat switch means and producing an output signal when the OFF time of the output signal from the switch means is longer than a predetermined time, manually controlled flying duration circuit means in said running circuit means for variably setting said predetermined time, and an indicating means for receiving the output of said running circuit means and for indicating the number of steps taken by a user.

2. A running machine comprising a mat means having mat switch means for producing a first output signal when the mat member is depressed, a running circuit means coupled to said mat switch means for processing the output signal from the mat switch means to produce an output signal when the OFF time of the output signal from the switch means is longer than a predetermined time, said running circuit means including flying duration circuit means for setting the predetermined time and program means for setting the number of steps to be taken by a user, informing means for producing an audible output when the output of the running circuit means corresponds to a determined number of steps, and an indicating means for receiving the output of said running circuit means and for indicating the number of steps taken by a user, said informing means including a sound emitting device for producing intermittent sounds which set the pace of the stepping and a warming up circuit means for gradually increasing the pitch of said intermittent sounds from a slower initial pitch to a predetermined faster pitch whereby a user's running speed is gradually increased from an initial slower speed to a faster predetermined speed.

3. A running machine as claimed in claim 2 wherein the informing means includes a warning sound emitting means for producing a warning sound when the output signal from the mat switch means does not coincide with said intermittent sound.

4. A running machine as claimed in any one of claims 1–3 wherein said running circuit means comprises a power supply switch, a starting switch, a running counter circuit coupled to said starting switch, a display element driving circuit coupled to the output of said running counter circuit, a pacemaker circuit coupled to said power supply switch, a sum-coincidence circuit coupled to the outputs of said running counter circuit and said pacemaker circuit, and an audible indicator driving circuit coupled to the output of said pacemaker circuit and sum-coincidence circuit.

* * * * *